US005950833A

United States Patent [19]

James

[11] Patent Number: 5,950,833

[45] Date of Patent: Sep. 14, 1999

[54] INFLATED, STACKABLE, BAG PACKAGE FOR CRUSHABLE ROUND ARTICLES

[75] Inventor: Thomas J. James, Franklin Lakes, N.J.

[73] Assignee: Nabisco Technology Company, Wilmington, Del.

[21] Appl. No.: 09/129,237

[22] Filed: Aug. 5, 1998

[51] Int. Cl.[6] ..... B65D 81/14; B65D 85/30

[52] U.S. Cl. ..... 206/522; 206/445; 426/110; 426/124

[58] Field of Search ..... 206/445, 522, 206/521; 426/124, 110, 106, 113

[56] References Cited

U.S. PATENT DOCUMENTS

| | | | |
|---|---|---|---|
| 2,494,446 | 1/1950 | Moore . | |
| 3,212,907 | 10/1965 | Caprioli . | |
| 3,346,101 | 10/1967 | Pestka . | |
| 3,740,238 | 6/1973 | Graham . | |
| 3,929,227 | 12/1975 | Burdis | 206/522 X |
| 3,987,736 | 10/1976 | Miller | 206/522 X |
| 4,011,347 | 3/1977 | GonNitz | 426/124 |
| 4,465,188 | 8/1984 | Soroka et al. . | |
| 4,623,064 | 11/1986 | Ruda | 206/445 |
| 5,137,154 | 8/1992 | Cohen . | |
| 5,143,775 | 9/1992 | Olsson et al. . | |
| 5,180,060 | 1/1993 | Forti et al. . | |

FOREIGN PATENT DOCUMENTS

| | | |
|---|---|---|
| 1551895 | 1/1969 | France . |
| 2389547 | 12/1978 | France . |
| 3827 858 A1 | 3/1989 | Germany . |
| 3-14478 | 1/1991 | Japan . |
| 4-128160 | 4/1992 | Japan . |
| 2 033 867 | 5/1980 | United Kingdom . |

*Primary Examiner*—Bryon P. Gehman

[57] ABSTRACT

A package is provided for cushioning a crushable article having a rounded edge. The package includes an outer wrapper structurally supported from the inside by inflated or inflatable cushions and by articles packaged in the package. The package tightly conforms to the shape of the article or stack of articles packaged therein thus minimizing space requirements. The inflated or inflatable cushions may be disposed along the inside of the outer wrap to support at least one face, and side edges of the package. The positioning of the cushions and the outer shape of the package are such that the package can be laid flat on a face thereof, stacked one on top of another, stood up on a side edge thereof, or stood up on an end thereof.

27 Claims, 7 Drawing Sheets

FIG. 8
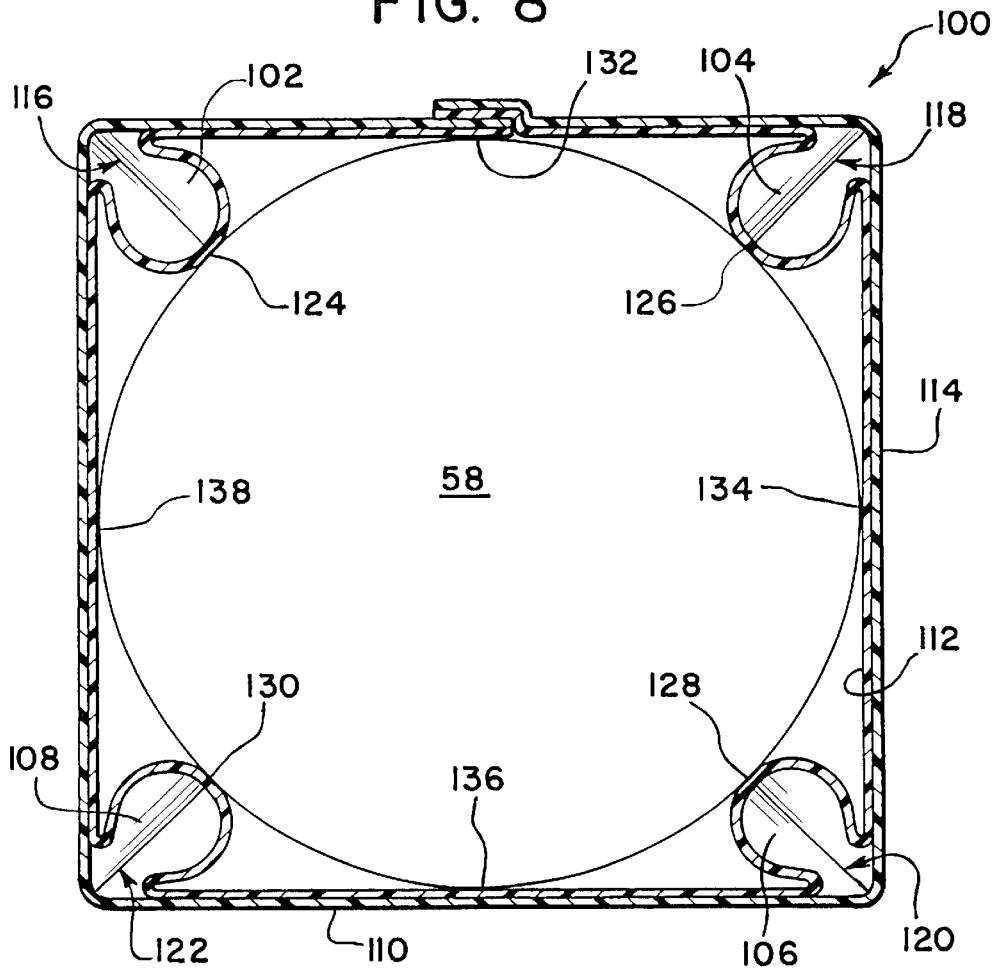
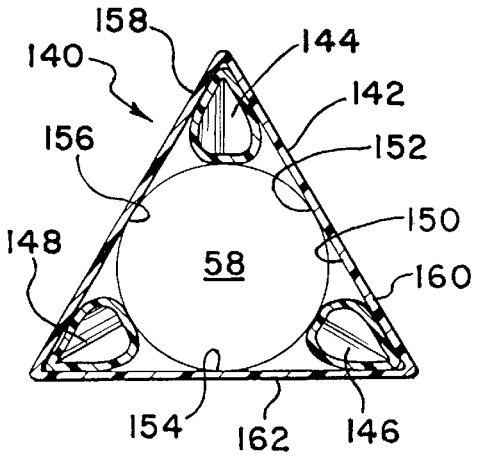
FIG. 9
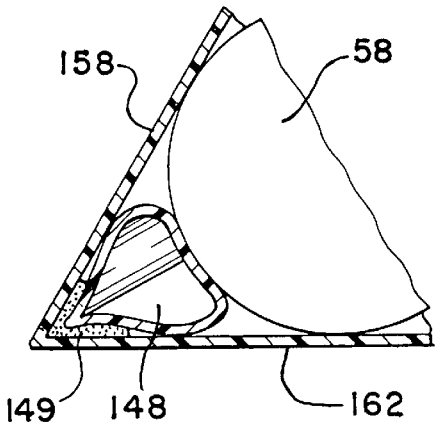
FIG. 10

INFLATED, STACKABLE, BAG PACKAGE FOR CRUSHABLE ROUND ARTICLES

FIELD OF THE INVENTION

The present invention relates to packages and package inserts for crushable articles, particularly crushable food products having a rounded edge. More particularly, the present invention relates to a package for crushable or damageable, substantially circular articles, that can be laid flat, stacked, and/or stood up on a side edge or end.

BACKGROUND OF THE INVENTION

Flexible film bags are a relatively inexpensive and convenient package for snack items such as cookies, which are produced on a mass production, continuous basis. However, they are difficult to stack one upon another on a grocery shelf or display stand because of their flexibility and conformableness to the shape of their contents. The stacking problem is particularly acute where the articles, such as cookies are round circular and packed in one or more rows. While a package with a plurality of rows of cookies may be stacked on their major faces, the rounded edges of the cookies hinder stable stacking of large numbers of packages. In addition, the rounded edges prevent stacking and free-standing of the packages on their minor longitudinal surfaces. Standing and stacking of the packages on their minor surfaces is desirable because it displays the major surface of the package to the consumer. In addition, fragile or crushable articles such as cookies are often damaged in flexible film bags during transport or handling due to their lack of cushioning or rigid supports.

U.S. Pat. No. 2,494,446 to Moore, U.S. Pat. No. 3,212,907 to Caprioli and U.S. Pat. No. 3,740,238 to Graham disclose food packages which include trays for holding crushable food products with rounded edges. According to the patents, the tray containing the food product is packaged within an outer, transparent plastic wrapper. To access a food product contained in the packages, the tray is either partially removed from the outer wrapper or the wrapper is torn, destroying the reclosability of the package. To preserve a packaged food product after the package is initially opened, it is preferred that the wrapper is kept substantially intact and after the tray is at least partially removed from the outer wrapper the tray is then forced back into the outer wrapper, which can be a difficult task. Often, problems arise when reinserting the tray into the outer wrapper, for example, the tray may be cracked or otherwise broken, the outer wrapper may rip or tear, and the necessary force required for reinsertion can lead to breakage of the food products. In addition, removable trays can be relatively expensive to manufacture, and require expensive packaging equipment for loading and insertion into an outer wrapper. In addition, the trays of U.S. Pat. Nos. 3,212,907 and 3,740,238 do not impart squared-off corners to the package. Thus, neither package can be stood up on a side edge or an end.

Packages including inflatable or inflated cushioning means for protecting breakable articles are disclosed in U.S. Pat. No. 3,346,101 to Pestka, U.S. Pat. No. 4,465,188 to Soroka et al, U.S. Pat. No. 5,137,154 to Cohen, U.S. Pat. No. 5,143,775 Olsson et al, and U.S. Pat. No. 5,180,060 to Forti et al, French Patent Publication Nos. 1,551,895 (published Jan. 3, 1969), 2,389,547 (published Dec. 1, 1978), German Patent Publication No. DE 3,827,858A (published Mar. 2, 1989), Great Britain patent publication no. 2,033,867A (published May 29, 1980), and Japanese Patent publication nos. 3-14478 (published Jan. 23, 1991) and 4-128160 (published Apr. 4, 1992).

For example, Japanese patent publication no. 4-128160 discloses a package comprising a material having air-filled cushioning parts provided on a base plate. When an article is wrapped in the material the cushioning parts surround and cushion the article. The cushioning parts maintain the article spaced from the base plate and the article does not lend direct structural support to the base plate, but rather only indirectly contacts the base plate through the cushioning parts. In the case where an article having a rounded surface is packaged within the material, the volume of the package is considerably larger than the volume of the article because the article is spaced on all sides from the base plate. Thus, shipping, storing and displaying the packaged article require more room than would be required by a package which more closely conforms to the shape of the article.

An article packaged in the material disclosed in Japanese Patent publication 4-128160 is also difficult to view without opening the package even if the base plate and cushioning parts are transparent. Obstructed viewing can be difficult due to optical distortion through the multiple layers of material and the spacing of the article away from the outer surface of the package.

The present invention provides a flexible film, free-standing bag-like package that tightly conforms to an article packaged therein, and cushions a crushable article having a rounded edge packaged therein without the need for a rigid plastic or rigid cardboard tray. The package can be laid flat, stood up on a side edge or end, and stacked one on top of another or row on top of row. The package may also be transparent to allow substantially undistorted viewing of a major portion of an article packaged therein.

SUMMARY OF THE INVENTION

The present invention provides a flexible film package, with increased rigidity and stackability imparted by cushioning, for crushable articles having a rounded edge or circular shape. An outer flexible wrapper is structurally supported from the inside by: 1) longitudinal inflated or inflatable cushions, or completely sealed air channels, and 2) round articles packaged therein. The articles may be arranged in rows or stacks with the major surface of each article, such as a circular cookie or cracker, perpendicular to the major sides of the package. Packages according to the present invention tightly conform to the shape of articles packaged therein thus minimizing space requirements. According to embodiments of the invention, the inflated or inflatable cushions are disposed along the inside of the outer wrapper to support at least one face, and side edges of the package. The positioning of the cushioning may be such that the package can be laid flat on a face of the package, stacked one on top of another or row on top of row, stood up on a side edge thereof, or stood up on an end thereof. Trayless, flexible bag-like packages of the present invention may be stood on their sides without any external side support. In embodiments of the invention, the flexible bag-like packages may be used as flexible film package inserts or flexible film trays for insertion into flexible film wrappers or cartons.

According to embodiments of the invention, a package is provided which can cushion a crushable article or stack packaged therein having a rounded edge and which can provide an at least substantially flat outer package surface opposite an inner surface of the outer wrapper supported by the rounded edge of the article or stack and by cushioning on both sides of the rounded edge. In embodiments of the invention, the cushions impart squared-off or substantially perpendicularly shaped corners and edges to a flexible wrapper or film so that the package may be stacked on its side edge or minor longitudinal surfaces. The cushions also impart rigidness to the sides and corners for stackability. For example, four cushions can be used to form a package having an outer surface of substantially square cross-section if substantially equally spaced around the rounded edge of a substantially circular cookie. According to embodiments of the invention, the outer surface of the package is supported not only by the four inflated cushions but also by four substantially equally spaced edge portions of the circular rounded edge.

Packages having rectangular outer surface cross-sections are made according to embodiments of the present invention by providing an even number of parallel elongated substantially cylindrical cushions surrounding a plurality of substantially cylindrical articles or stacks or rows of articles such that four cushions surround each article or stack of articles on four substantially equally spaced side edge portions thereof. According to embodiments of the invention, the number of parallel elongated substantially cylindrical cushions is equal to 2n+2 wherein n is the number of rows of substantially cylindrical articles or stacks of articles packaged between the cushions.

According to embodiments of the invention, the outer wrapper of the package is at least partially supported by crushable articles having rounded edges packaged therein, yet the package nonetheless cushions and protects the crushable article. The provision of having the article contact and support the outer wrapper provides at least substantially flat surfaces having neat corners provided by the cushions. It also ensures a package of minimal volume requirement that is stackable and may be stood up on a side edge, stood up on an end, or laid flat on an outer major surface.

According to embodiments of the invention, an article or stack of articles having a rounded edge is packaged in the package and the inflated cushions are spaced from one another and maintained in position by the inner surface of the package so that the rounded edge of the article or stack can contact two or more adjacent cushions and the inner surface of the package between adjacent cushions. An at least substantially flat outer surface results which is supported by the adjacent cushions and by the rounded edge of the article or stack contacting the inner surface.

According to some embodiments of the invention, the wrapper may comprise a polymeric sheet material and the cushioning may also comprise the polymeric sheet material. According to embodiments of the invention, the package may be provided with end walls comprising the wrapper. According to some embodiments of the invention, the inflated cushion is attached to the inner surface of the wrapper by adhesion, cohesion or melting. The cushioning may or may not be attached to one or more end walls of the package. Multiple cushions may be continuously formed with each other with open communications between the multiple cushions. Each cushion may be a single channel or chamber or may be segmented into a plurality of linearly aligned chambers, which may or may not be in gaseous communication with each other. A single channel or chamber which is at least substantially coextensive in length with the rows of articles is preferred. According to some embodiments of the invention, an inflatable cushion having a fill-valve can be provided.

In some embodiments of the invention, a package insert component, which may be insert or tray is provided for packaging a crushable article having a rounded edge. The insert or tray comprises a flexible wrapper and inflatable cushions supported by the wrapper in an operable, or cushioning, rigidity imparting position. The insert or tray can be inserted into an open-ended outer carton or flexible film bag and then used to package an article. In other embodiments, the flexible film insert or flexible film tray can be wrapped around an article prior to inserting the wrapped article in an outer film wrapper or carton.

BRIEF DESCRIPTION OF THE DRAWINGS

FIG. 8 is a cross-sectional end view through a package according to another embodiment of the present invention;

FIG. 9 is a cross-sectional end view through a package of yet another embodiment of the present invention;

FIG. 10 is an enlarged view of a portion of the package shown in FIG. 9;

DETAILED DESCRIPTION OF THE INVENTION

Figure 1:
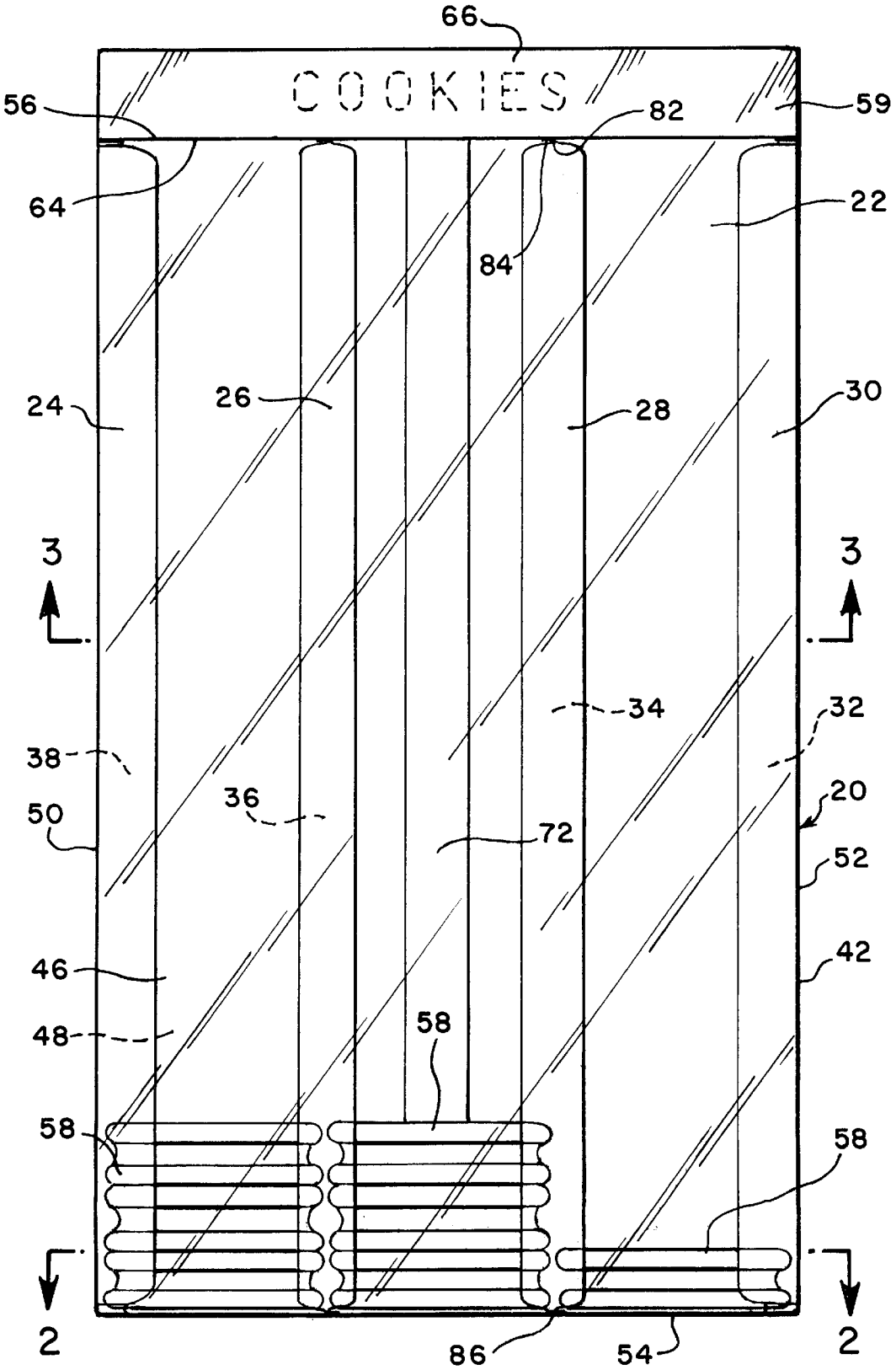
FIG. 1 is a top plan view of a transparent, inflated, standable, stackable, flexible film cookie package according to an embodiment of the present invention.

According to embodiments of the invention, a package for a breakable or fragile article having a rounded edge or at least substantially circular periphery is provided. The package is standable and stackable when a row of said baked goods within the package are stood up on their rounded edges. The package comprises a flexible wrapper which forms a package sidewall having an outer surface and an opposite inner surface. A plurality of inflated or gas-filled cushions are supported by or attached to or integral with the inner surface of the wrapper. An end wall is connected to or formed integrally with the sidewall. At least a portion of said outer surface comprises an at least substantially flat area on which the package is standable when an article having a rounded edge is packaged therein.

The inflated cushions are positioned around a packaged article and spaced from one another. The cushions are preferably supported by the inner surface of the wrapper so that when a crushable or damageable article having a rounded edge is packaged inside the package the rounded edge of the article can contact two or more adjacent cushions and the inner surface of the sidewall between the adjacent cushions. As a result, an outer sidewall having a substantially planar flat surface is supported by adjacent cushions and by the rounded edge of the article contacting the inner surface of the sidewall between the adjacent cushions.

According to embodiments of the invention, the wrapper may comprise a polymeric sheet material and the cushions may also comprise the polymeric sheet material. The wrapper preferably comprises a flexible, transparent food-grade wrapping material or flexible film, for example, cellophane. Other materials which may be used for the wrapper or film include polyolefinic materials, for example, polyethylenes, polypropylenes and polybutenes, polystyrene, polybutadiene and saran wrap.

According to embodiments of the invention, the package may be provided with end walls comprising the wrapper. Hot melt adhesives, or other adhesives or cohesive bonding means may be used to form a package from the wrapper and cushioning materials. A thermoplastic lacquer may be used to seal the wrapper to itself. The package may also be made by hot melting, heat sealing, or welding edges of the wrapper to each other. The wrapper may be wrapped around to form a tubular shape then bonded or otherwise attached to itself to form a package sidewall having an outer surface and an inner surface, with cushions disposed on the inner surface of the sidewall.

According to some embodiments of the invention, the inflated or gas-filled cushion is attached to the inner surface of the wrapper by adhesion, cohesion or melting. Hot melt adhesives, hot melting or heat sealing may be used to adhere the cushion to the inner surfaces or to the elongate internal corners of the package. According to some embodiments of the invention, the wrapper comprises two plies of polymeric sheet material bonded to each other, for example, two plies of biaxially tentered plastic wrap, wherein cushions are formed by providing air-filled pockets at strategic areas between the two plies. An exemplary method of making a two-ply wrapping material having air-filled pockets formed between the two plies is disclosed in U.S. Pat. No. 5,143,775 to Olsson et al., which is herein incorporated by reference in its entirety.

In some embodiments of the invention, a package insert or package tray is provided for packaging a crushable article or articles having a rounded edge or periphery. The insert or tray comprises a flexible wrapper and inflated or gas-filled cushions supported in an operable position by the wrapper. The insert or tray can be inserted into an outer flexible bag or carton. Then to package the article it may be inserted through an open end of the flexible bag or carton into the flexible insert or tray. Alternatively, the flexible insert can be wrapped around an article prior to inserting the wrapped article in an outer flexible bag or carton. Also, the articles may be placed or at least partially wrapped in a flexible film cushioned tray prior to inserting the wrapped article into an outer flexible bag or carton.

The cushions may comprise thin-walled polymeric tubes filled with air or other gas. The polymeric tubes are preferably flexible, elastic and compressible. The tubes may comprise a plastic material such as a polyolefinic material. According to some embodiments of the invention, the tubes may comprise a saran material, or a biaxially tentered or stretched polymeric film or laminate.

Each cushion may be a single, sealed or air-tight channel or chamber, or segmented into a plurality of linearly aligned chambers. The aligned chambers may or may not be in gaseous communication with each other. Single, longitudinally oriented channels or tunnels are preferred. Each of the cushions is preferably at least substantially coextensive with or about the same length as each full row of articles, or the internal length of the package. The cushions may be filled or inflated with air or other gas during production of the package. Valved passageways may be employed for filling the channels.

The cushion may be made separately from the wrapper and then adhered, cohered, hot melted or otherwise connected to, or held in place by, the wrapper. Alternatively, the cushioning may be integrally formed or molded from the wrapper material. According to some embodiments of the invention, the cushioning may be formed from a second ply of film connected to the entire inner surface of the wrapper except where cushions are provided as air-filled chambers or channels formed by spacing areas of the second ply from the inner surface of the wrapper. For example, chambers may be made in the corners of the package alone or in combination with chambers substantially equally spaced along the sidewalls between the corners. The spacing of the cushions permits the outer edge or periphery of the article, such as a cookie or cracker, to contact the inner substantially flat surface of the flexible wrapping in a tangential manner. Also, the spacing of the cushions may be such so as to permit adjacent rows of articles to lightly contact each other or to keep them slightly separated to reduce any breakage or crumbling caused by relative movement against each other.

Multiple packages according to the invention can be stacked on top of one another or stood up, either individually or one on top of another. According to some embodiments of the invention, the filled packages can be standable and/or stackable on a side edge or minor longitudinal surface, or end. Furthermore, because the package material is thin and flexible, and the package closely contours the shape of cookies or other crushable or fragile articles packaged therein, the filled package takes up a minimum amount of shelf space, display space, stock storage space and transportation storage space. For example, a package having a plurality of rows of round cookies, crackers, or other baked goods may be standable on either of its side edges or minor longitudinal surfaces, with the rows arranged vertically above each other.

Although the substantially rectanguloid package shown in FIGS. 1–6 comprises eight tubular cushions for protecting and containing three stacks or rows of cookies, other packages according to embodiments of the present invention may also be provided having other numbers of cushions for protecting and containing other numbers of cookies or other rounded articles or stacks or rows of cookies or other rounded articles, particularly crushable cookies, articles or stacks. For example, the package may have a substantially square, triangular, or trapezoidal cross-section taken perpendicular to the most elongated dimension of the package.

According to some square cross-section embodiments of the invention, the package may comprise four inflated cushions, one in each respective elongate internal corner edge of the package. The package protects and contains a single substantially cylindrical stack or row of cookies or other crushable articles packaged therein. The four cushions preferably each contacts and cushions a region of each cookie or article of the stack or row. According to embodiments of the invention, each cushion may be substantially equally spaced from adjacent cushions on opposite sides thereof.

According to some embodiments of the invention, the package may have a substantially rectangular cross-section, be provided with six substantially parallel tubular cushions, and be designed for protecting and containing two stacks or rows of cookies or other crushable or damageable articles.

Packages having cross-sections of shapes other than square or rectangular may be provided according to embodiments of the invention. For example, packages of triangular or other polygonal cross-section may also be provided. Packages having an even number of equilateral sides are preferred according to embodiments of the invention and preferably can be stacked or stood up one on top of another. For example, packages of substantially perfect hexagonal or substantially perfect octagonal cross-section may be provided and may be stacked one on top of another or stood up, individually or on top of one another. Packages having trapezoidal cross-section may be provided according to some embodiments of the invention. Packages of equilateral triangular cross-section can also be stacked parallel to one another with an upside-down package being supported by and between two adjacent right-side-up packages.

According to embodiments of the invention, a substantially diametrical dimension of each cushion is preferably from about 10% to about 75% the diameter of a substantially cylindrical cookie or other crushable article, or stack or row of cookies or other crushable articles disposed within, or to be packaged within, the package. Preferred substantially diametrical dimensions depend on the number of cushions used and the size of the article or stack to be packaged. According to embodiments of the invention wherein a package of parallelepiped or rectanguloid shape is provided and the package has a dimension substantially equal to the diameter of an article or stack packaged therein, for example, a package having eight cushions and three parallel side-by-side stacks or rows of cookies packaged therein, the diameters of the cushions may each be from about 15% to about 40%, for example, from about 20% to about 28% the diameter of each stack or row of cookies cushioned by the respective cushions.

According to a preferred embodiment of the invention wherein a package of parallelepiped or rectanguloid shape is provided and has eight cushions and three parallel side-by-side stacks of cookies packaged therein, the diameter of each cushion is preferably about 25% the diameter of each stack of cookies or articles.

According to embodiments of the invention, the diameters of the respective cushions, and the sums of the diameters of the cushions, are such that the package wrapper, when wrapped around an article or stack, touches radial edge portions of the article or stack and maintains the cushions in contact with the article or stack. Also, the wrapper forms at least substantially flat planar outer package surfaces having no substantial protrusions therefrom, with each outer planar surface extending between two adjacent cushions and the ends of the package. According to embodiments of the invention, the inner surface of the wrapper contacts and is partially supported by the respective radial edge portions of the article or stack at regions between each two adjacent cushions.

According to embodiments of the invention, a package having a triangular cross-section may be provided with three faces and three cushions, wherein the package comprises three elongate internal corner edges which are parallel to one another and wherein the cushions are provided parallel to one another, one in each respective elongate internal corner edge. The package may comprise three inner faces and two inner end surfaces. The internal corners are formed by the intersections of each of the three pairs of adjacent inner surfaces. Each cushion may preferably be equally spaced from the other two. Each may preferably comprise a gas-filled tubular polymeric cushion having a substantially tear-drop shaped cross-section with the pointed end of the tear-drop seated in the respective internal corner edge of the package. According to such embodiments, the diametrical dimension of the cushion perpendicular to a diametrical dimension extending through the pointed end of the tear-drop is from about 30% to about 45%, for example, from about 35% to about 40%, the diameter of a substantially cylindrical cookie or other crushable article, or stack or row of cookies or other crushable articles disposed within, or to be packaged within, the package.

According to embodiments of the invention, packages of triangular cross-section are provided with three cushions wherein the diameters of the three cushions, and the sums of the diameters of the cushions, are such that the package wrapper, when wrapped around the article or stack touches three equally spaced radial edge portions of the article or stack and supports the cushion in contact with the article or stack. Also, the wrapper forms three at least substantially flat planar outer package surfaces having no substantial protrusions therefrom with each outer planar surface extending between two adjacent cushions and the ends of the package. According to embodiments of the invention, each of the three inner surfaces of the wrapper contacts and is partially supported by the respective radial edge portions of the article or stack of articles packaged therein at regions between each two adjacent cushions.

Packages of shapes other than parallelepiped or rectanguloid are provided according to some embodiments of the invention. For example, packages of cubical shape may be provided as may packages of pyramidal shape. Pyramidal packages having a square base or a triangular base may be provided according to some embodiments of the invention.

Packages according to the present invention of many shapes and designs will become even more apparent with reference to the drawings wherein like reference numerals in different Figures indicate the same or a similar feature. The thicknesses of the wrapper materials and the cushioning materials are greatly exaggerated in the drawings. Exemplary wrapper and cushioning sheet thicknesses may be from about 10 microns to about 10 mils, depending upon the article to be packaged, the strengths of the polymeric or other sheet material used to form the wrapper and cushioning. Exemplary sheet material thicknesses for biaxially stretched polyolefinic polymeric sheets are from about 20 gauge to about 1000 gauge in thickness, preferably from about 40 gauge to about 400 gauge in thickness.

FIGS. 1–6 are different views of a transparent, inflated, standable, stackable, trayless cookie package 20 according to an embodiment of the present invention. The package 20 comprises a flexible wrapper 22 and inflated, substantially cylindrical and tubular cushions 24, 26, 28, 30, 32, 34, 36 and 38. The cushions are arranged substantially parallel to one another and substantially equally spaced around the inner surface 40 of the wrapper 22. The wrapper 22 comprises a sidewall 42 having an outer surface 44 and the inner surface 40. The outer surface 44 of the wrapper 22 comprises a top surface 46, a bottom surface 48, side surfaces 50 and 52, a closed end 54 and a reclosable end 56. When filled with cookies 58 arranged substantially cylindrically, as for example is shown by the few sandwich cookies 58 shown in three rows in FIGS. 1 and 2, the package can be displayed by laying flat on the top surface 46 or bottom surface 48, or by standing up on either side 50, 52 or either end 54, 56.

The reclosable end 56 of the package may comprise a tamper-evident seal, a resealable seal (not shown) or a reclosable closure 59, or combinations of tamper-evident seals and reclosable seals, such as zippered seals or wire ties. The closed end may, in an untampered state, comprise two edge portions 60,62 (FIG. 6) of the wrapper 22 welded together to form a weld joint 64, with or without being folded over on themselves. A label 66 comprising, for example, a paper material, may be used at the closed end to conceal the weld joint 64.

Figure 2:
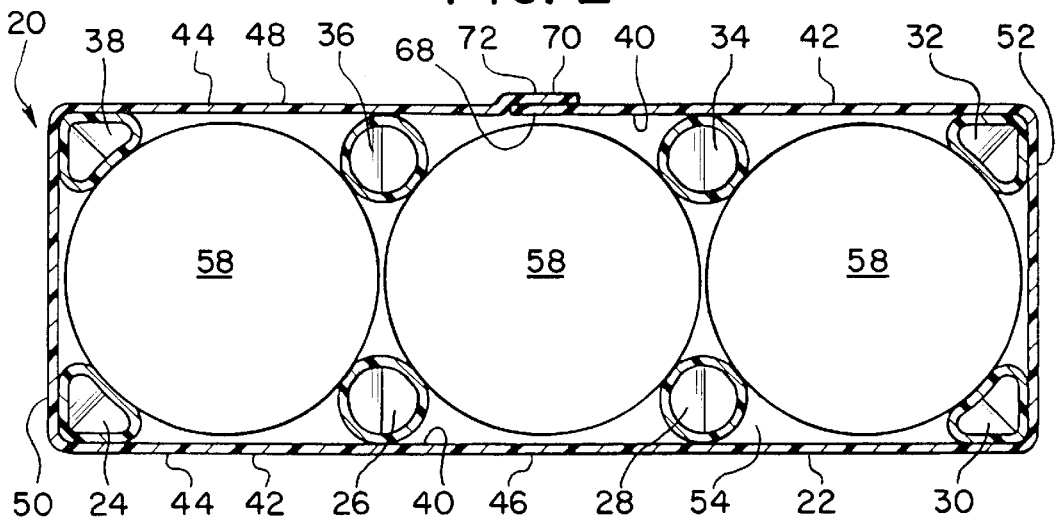
FIG. 2 is a cross-sectional view taken along line 2—2 of FIG. 1.
Figure 6:
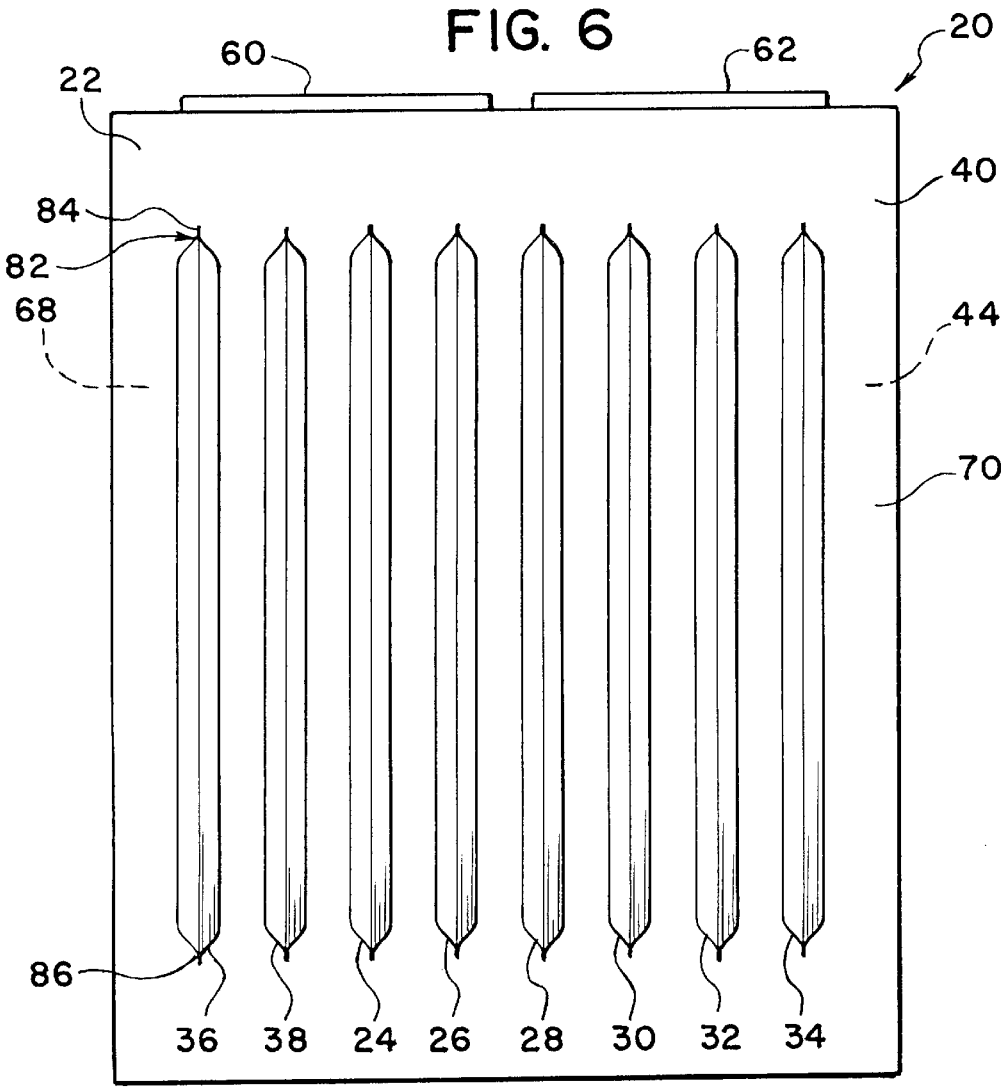
FIG. 6 is a top plan view of a packaging material according to an embodiment of the present invention that can be used as a package insert or sealed on itself to form a package, for example, the package shown in FIGS. 1–5.

As can be seen in FIGS. 2 and 6, the package 20 has edges 68,70 which are welded or sealed to each other at a substantially central, longitudinal joint 72 to form the package sidewall 42, including inner surface 40, outer surface 44, top surface 46, bottom surface 48, side surfaces 50 and 52, closed end 54 and reclosable end 56.

Figure 3:
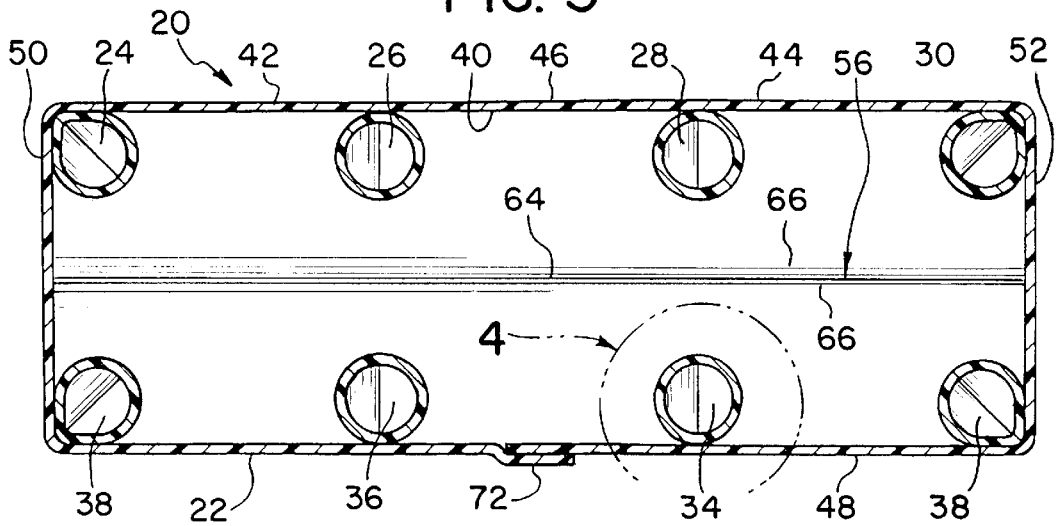
FIG. 3 is a cross-sectional view taken along line 3—3 of FIG. 1.
Figure 4:
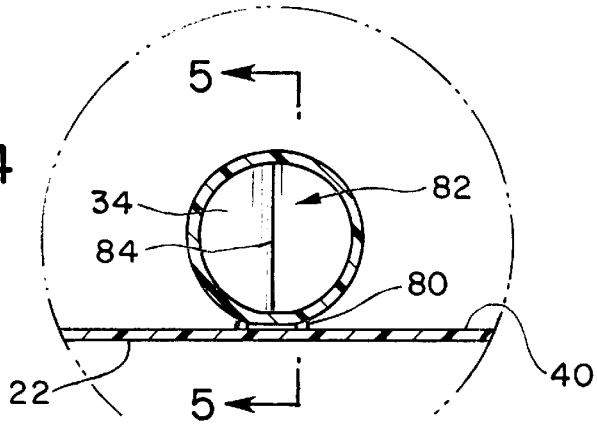
FIG. 4 is an enlarged view of the section defined by circle 4 of FIG. 3.
Figure 5:
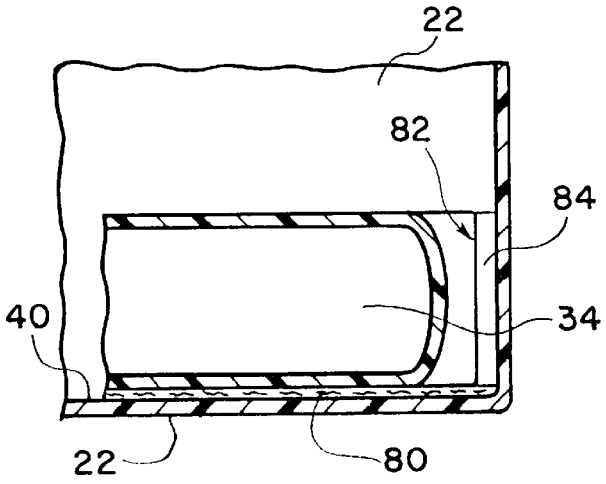
FIG. 5 is a cross-sectional view taken along line 5—5 of FIG. 4.

FIGS. 4 and 5 show an enlarged detail of the package embodied in FIGS. 1–3 wherein it can be seen that cushioning 34 is bonded to the inner surface 40 of the wrapper 22 with an adhesive bead or strip 80. The adhesive may comprise, for example, a hot melt adhesive, a low density polyethylene adhesive, a polyacrylate adhesive, a polysiloxane adhesive, or other material that substantially permanently bonds the cushioning to the inner surface 40 of the wrapper 22.

FIGS. 4 and 5 show a closed end 82 of cushioning 34. The closed end of the cushioning provides a gas-tight or air-tight seal 84. The seal 84 may be provided by a weld joint made by welding together internal sidewall surfaces of the polymeric tubular cushioning material. Another gas-tight or air-tight seal is provided at an opposite closed end 86 of cushioning 34, as seen in FIG. 1.

To provide for a perfect fit between an article or stack and the cushioning in a package having multiple cushions, the diameters of all the cushions need not be the same. For example, to provide a perfect fit for cookies of 1.75 inch diameter using standard ⅜ and 7/16 inch dies for extrusion molding tubular cushions, the diameters of two diagonally opposed internal cushions may be slightly less than the diameter of the remaining six cushions. For example, the diameters of cushions 28 and 36 may be ⅜ inch while the diameters of the remaining cushions 24, 26, 30, 32, 34 and 38 may be 7/16 inch. In embodiments of the invention, one or more internal cushions 26, 28, 34, and 36 which are between rows of cookies may be omitted. The remaining corner cushions 24, 30, 32, and 38 still provide rigidity to the sides and corners and provide substantial squareness or perpendicularity to the edges and corners for standing and stacking of the package.

FIG. 6 shows the construction of an assembly comprising the wrapper 22 and cushions 24, 26, 28, 30, 32, 34, 36 and 38 before the assembly is folded over onto itself and welded to form package sidewall 42.

Figure 7:
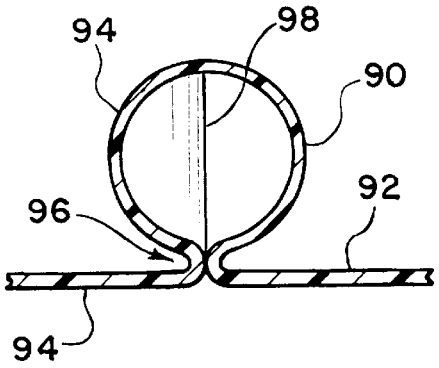
FIG. 7 is a cross-sectional view of another construction of a package wrapper and inflated cushion according to an embodiment of the present invention.

FIG. 7 shows a cross-sectional view through a portion of another embodiment of the present invention wherein a cushioning 90 is not adhered to the inner surface 92 of a package sidewall or package wrapper material 94, but instead is formed as an integral part of the sidewall or package wrapper material 94. The sidewall or material 94 is heat sealed or welded upon itself to form a seal 96. Heat seals, for example, seal 98, may be provided to seal ends of the cushioning 90.

FIG. 8 shows an embodiment of the present invention wherein a package 100 comprises four cushions 102, 104, 106 and 108, and a two ply wrapper 110 comprising inner ply 112 and outer ply 114. As can be seen from FIG. 8, the cushions comprise air-filled sacs, substantially cylindrical in shape, one in each respective internal corner 116, 118, 120 and 122 of the package. A substantially cylindrical stack of cookies 58 is cushioned on four respective side edge portions thereof 124, 126, 128 and 130, by the four respective cushions 102, 104, 106, and 108. One or more, for example all, of the four cushions 102, 104, 106, and 108 may be slightly deformed by or compressed by the cookies 58. Four respective side edge portions 132, 134, 136 and 138 of the stack of cookies 58 contact the inner surface of inner ply 112 and support the outer surfaces of the package. Methods of making two ply materials having air-filled portions between the plies are disclosed, for example, in U.S. Pat. No. 5,143,775 to Olsson et al., which, as discussed above, is herein incorporated by reference in its entirety.

FIGS. 9 and 10 show yet another embodiment of the present invention comprising an elongated package having a triangular cross-section. A stack of substantially cylindrical cookies 58 is wrapped by package 140. The package 140 comprises a wrapper 142 and three cushions 144, 146 and 148 bonded by an adhesive 149 to the inner surface 150 of the wrapper 142 in internal elongated corner edges. As with other embodiments of the invention, depending upon vacuum forces during initial sealing of the packed package, the wrapper 142 may bow inward more than shown in non-supported regions, for example, in regions between the cushions and the contacting edge of the stack. As can be seen from FIGS. 9 and 10, the cushions 144, 146 and 148 may be substantially tear drop-shaped in cross-section when not supporting a cookie or stack of cookies and substantially heart shaped in cross-section when cushioning a cookie or stack of cookies. The cushions are preferably of sufficient girth to provide an acute angle pointed corner while allowing the wrapper to contact and be supported by the edge portions 152, 154 and 156 of the cookie without causing a substantial protrusion or protruding edge rising from any of the three faces or sides 158, 160 and 162 of the package. According to some embodiments of the invention, the sum of the diameters of the three cushions may be from about 105% to about 120% the diameter of the stack of cookies.

Figure 11:
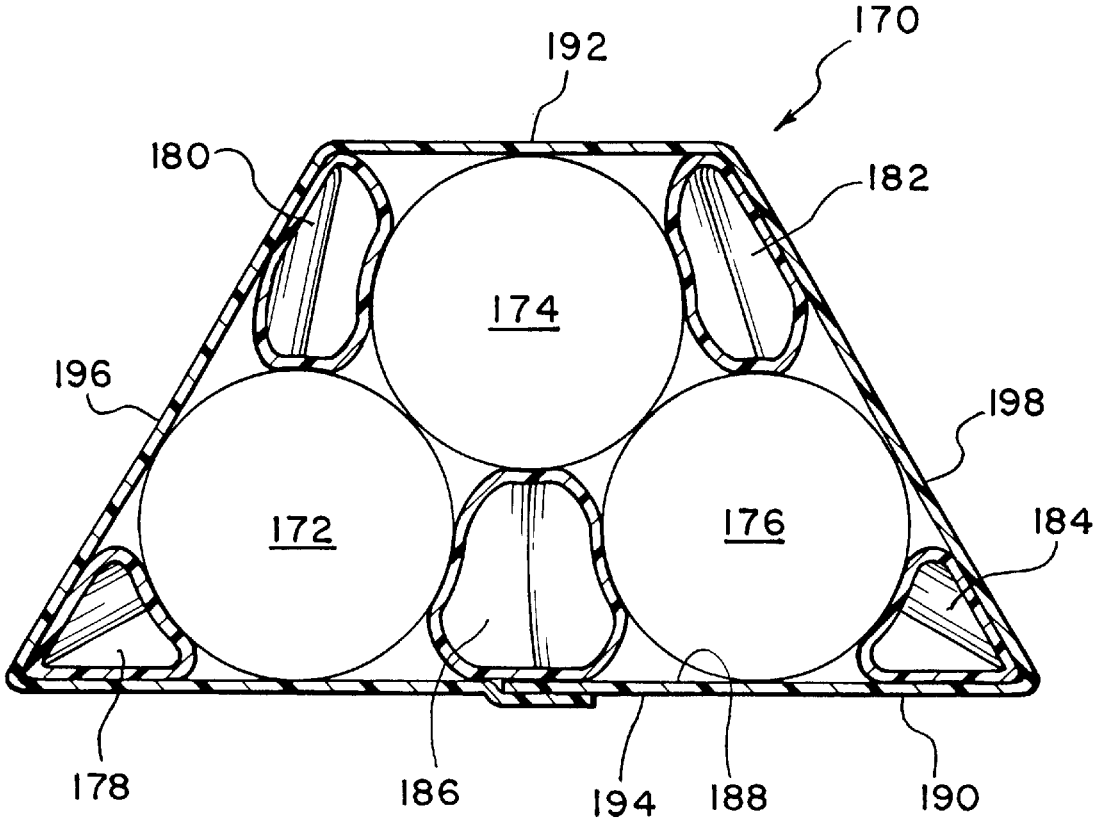
FIG. 11 is a cross-sectional end view through a package of yet another embodiment of the present invention.

FIG. 11 shows yet another embodiment of the invention wherein a package 170 according to the present invention is provided with a trapezoidal cross-section. Three stacks of cookies, 172, 174 and 176 are cushioned by five cushions 178, 180, 182, 184 and 186, attached to the inner surface 188 of a wrapper 190. As can be seen from FIG. 11, cushions of different girths are employed to form flat, planar faces 192 and 194 and flat side edges 196 and 198 while substantially filling the longitudinal spaces between the rows of cookies and the faces 192, 194 and edges 196 and 198.

In embodiments of the invention, flexible film cushioned packages as shown in FIGS. 1–11 may be used as is or without one or more closed ends as inserts for insertion into an outer flexible film wrapper or carton. The outer flexible film or carton may be wrapped around the insert to form a package. Also, the cushioned flexible film may be used to form open-topped or open-ended flexible cushioned trays for insertion into or wrapping within outer flexible wrappers or cartons.

Figure 12:
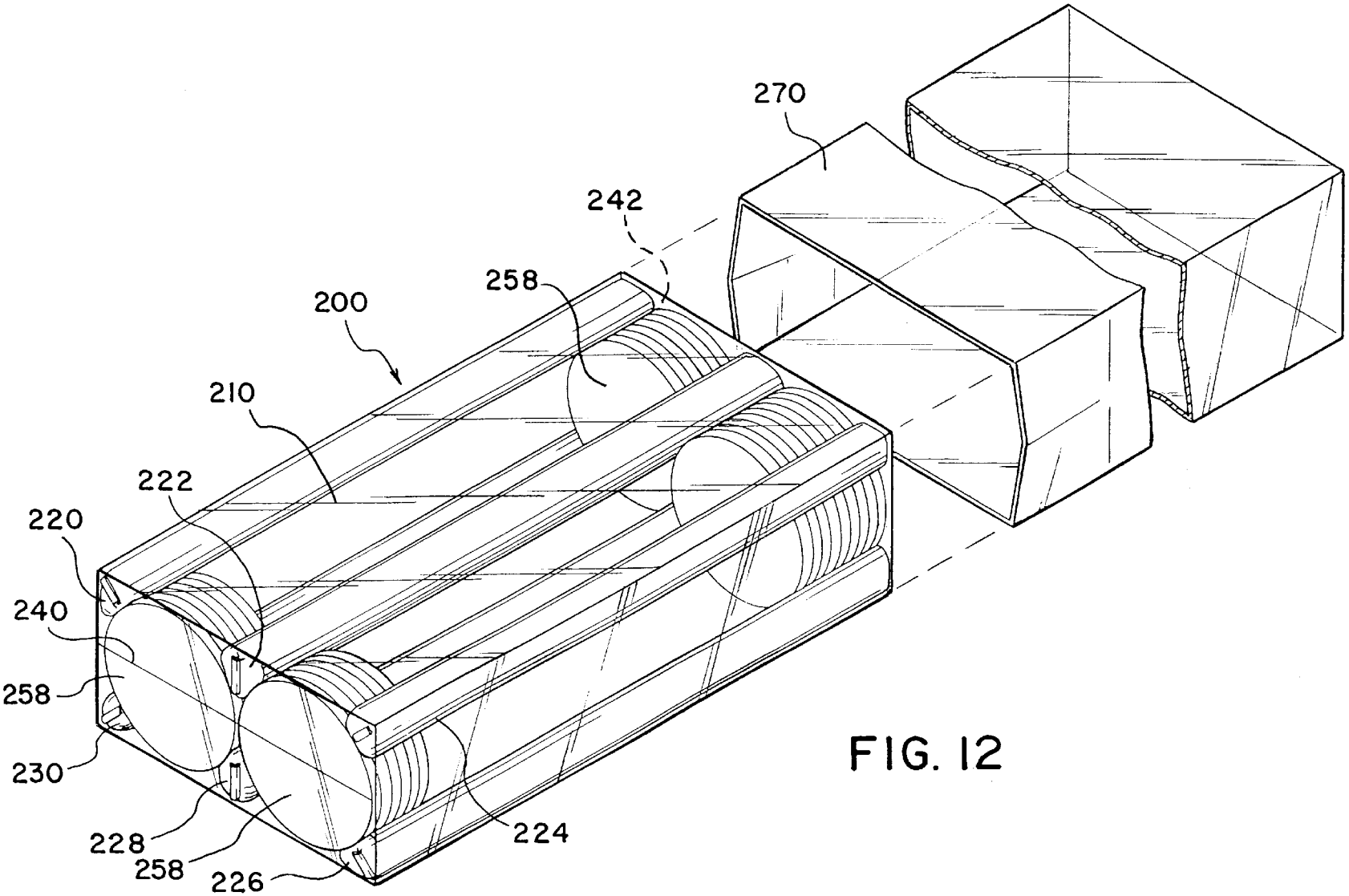
FIG. 12 is a perspective view of a transparent flexible film package insert and a flexible film outer wrapper into which the package insert is inserted to obtain a sealed package upon sealing of the outer wrapper to itself.

As shown in FIG. 12, a transparent, flexible film cushioned insert 200 comprising a flexible film wrapper 210, cushioning means 220, 222, 224, 226, 228, and 230, optional closed ends 240, 242, and two rows of round cookies 258 packaged therein may be inserted into an optionally resealable, flexible outer wrapper or sleeve, or carton 270.

Figure 13:
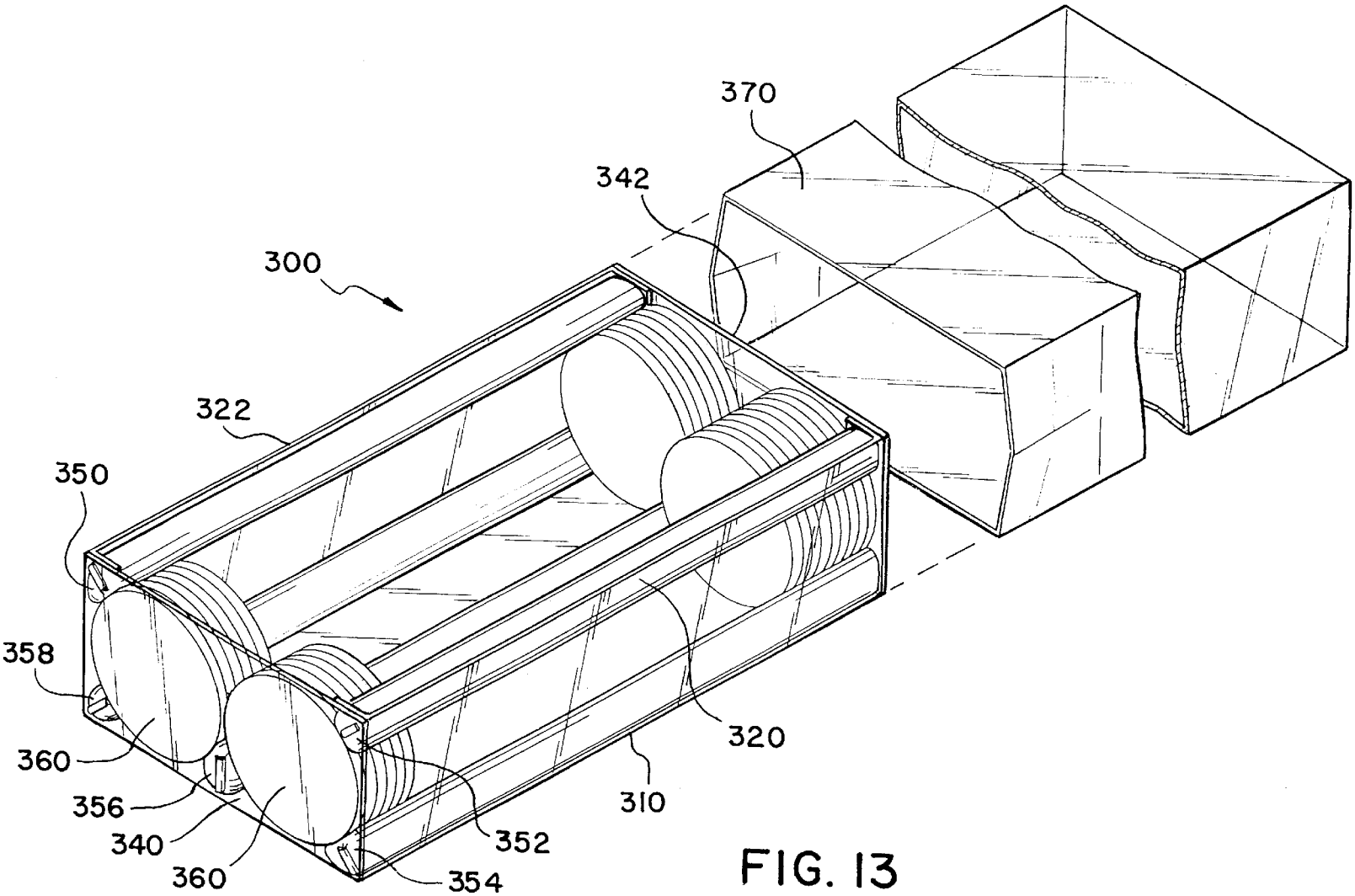
FIG. 13 is a perspective view of a transparent flexible film package tray and a flexible film outer wrapper into which the package tray is inserted to obtain a sealed package upon sealing of the outer wrapper to itself.

As shown in FIG. 13, a transparent, flexible film cushioned tray 300 having a bottom 310, an open top, opposing sides 320, 322, optionally sealed ends 340, 342, and cushioning means 350, 352, 354, 356 and 358, for cushioning two rows of round cookies 360 may be inserted into an optionally resealable, flexible outer wrapper or carton 370. The bottom 310, sides 320, 322 and sealed ends 340, 342 may all be formed from an integral or single flexible film.

What is claimed is:

1. A stackable, flexible, package for an article having a rounded edge, said package comprising a sidewall comprising a flexible wrapper, a plurality of inflated cushions, and an end wall connected to said sidewall at an end of said sidewall, said sidewall comprising an inner surface and an outer surface, said inner surface supporting said plurality of inflated cushions, at least a portion of said outer surface comprising an at least substantially flat surface on which said package is standable when an article having a rounded edge is packaged in said package, said inflated cushions being spaced from one another and supported by said inner surface so that when an article having a rounded edge is packaged inside said package, the rounded edge of the article can contact at least two adjacent cushions and the inner surface of said sidewall between said adjacent cushions such that a substantially flat outer surface is provided by said adjacent cushions and by the rounded edge of the article contacting the inner surface.

2. A package as claimed in claim 1 wherein said end wall comprises said flexible wrapper.

3. A package as claimed in claim 1 wherein said inflated cushions are inflated with a gas and sealed.

4. A package as claimed in claim 1 wherein said plurality of inflated cushions are attached to the inner surface of said flexible wrapper.

5. A package as claimed in claim 1 wherein said wrapper comprises a polymeric sheet material and said cushions also comprise, and are formed of, said polymeric sheet material.

6. A package as claimed in claim 1 wherein the number of cushions is equal to 2n+2 wherein n is the number of substantially cylindrical rows of stacked substantially circular articles packaged in said package.

7. A package as claimed in claim 1 having a plurality of rows of cookies, the rows of cookies and said cushions being longitudinally oriented and substantially coextensive in length.

8. A package as claimed in claim 1 wherein each cushion is a single air-filled chamber, and the cushions impart substantially squared corners to the flexible wrapper, said package being stackable upon each of its side surfaces.

9. A package as claimed in claim 1 comprising three substantially cylindrical cushions and further comprising a substantially cylindrical stack, said stack comprising at least one substantially cylindrical article, wherein said three cushions surround said stack and are substantially equally spaced from one another.

10. A package as claimed in claim 9 wherein the sum of the diameters of the three cushions is from about 105% to about 120% the diameter of the stack.

11. A package as claimed in claim 1 further including a crushable, substantially cylindrical stack of food products contained therein.

12. A package insert component comprising one of an insert and a tray for protecting a crushable article having a rounded edge, said insert component comprising a sidewall comprising a flexible wrapper and a plurality of inflated cushions, said sidewall comprising a bottom, opposing sides, an inner surface and an outer surface, said inner surface supporting said plurality of inflated cushions, at least a portion of said outer surface comprising a surface that is at least substantially flat when the insert is placed in an outer component comprising one of a wrapper and a carton, said inflated cushions being spaced from one another and supported by said inner surface so that when a crushable article having a rounded edge is wrapped in said insert component, the rounded edge of the article can contact at least two adjacent cushions and the inner surface between said adjacent cushions such that said flat outer surface of the flexible wrapper is provided by said adjacent cushions and by the rounded edge of the article contacting the inner surface.

13. A package insert component as claimed in claim 12 further including at least one crushable, substantially cylindrical stack of food product wrapped by the insert component and contained therein.

14. A package insert component as claimed in claim 12 wherein said plurality of inflated cushions are inflated with gas and sealed.

15. A package insert component as claimed in claim 12 wherein said inflated cushions are attached to the inner surface of said flexible wrapper.

16. A package insert component as claimed in claim 12 wherein said flexible wrapper comprises a polymeric sheet material and said cushions also comprise, and are formed of, said polymeric sheet material.

17. A package insert component as claimed in claim 12 wherein the number of cushions is equal to 2n+2 wherein n is the number of substantially cylindrical rows of stacked substantially circular articles to be packaged in said package.

18. A package insert component as claimed in claim 12 having a plurality of rows of cookies, the rows of cookies and said cushions being longitudinally oriented and substantially coextensive in length.

19. A package insert component as claimed in claim 12 wherein each cushion is a single air-filled chamber, and the cushions impart substantially squared corners to the flexible wrapper, said package being stackable upon each of its side surfaces.

20. A package insert component as claimed in claim 12 comprising three substantially cylindrical cushions and further comprising a substantially cylindrical stack wrapped inside said insert, said stack comprising at least-one substantially cylindrical article, wherein said three cushions surround and contact said stack and are substantially equally spaced from one another.

21. A package insert component as claimed in claim 12 wherein said flexible wrapper forms a sleeve with closed ends around a plurality of rows of articles.

22. A package insert component as claimed in claim 12 having an open top and closed opposing ends.

23. A stackable, flexible package comprising a resealable, flexible outer wrapper and a package tray as claimed in claim 22 contained therein.

24. A stackable package comprising a resealable outer carton and a package insert as claimed in claim 21 contained therein.

25. A stackable, flexible, package of baked goods each having a rounded edge, said package comprising a sidewall comprising a flexible wrapper, a plurality of inflated cushions, and an end wall connected to said sidewall at an end of said sidewall, said sidewall comprising an inner surface and an outer surface, said inner surface supporting said plurality of inflated cushions, at least a portion of said outer surface comprising an at least substantially flat surface on which said package is standable and stackable when a row of said baked goods within the package are stood up on their rounded edges, said inflated cushions being spaced from one another and supported by said inner surface so that each rounded edge of the baked goods in said row contacts at least two adjacent cushions and the inner surface of said sidewall between said adjacent cushions.

26. A package as claimed in claim 25 having a plurality of rows of cookies, the rows of cookies and said cushions being longitudinally oriented and substantially coextensive in length.

27. A package as claimed in claim 25 wherein each cushion is a single air-filled chamber, and the cushions impart substantially squared corners to the flexible wrapper, said package being stackable upon each of its side surfaces.

* * * * *